US006723240B1

(12) United States Patent
Minemura

(10) Patent No.: US 6,723,240 B1
(45) Date of Patent: Apr. 20, 2004

(54) SLUDGE REMOVING DEVICE

(75) Inventor: Kazuo Minemura, Mooka (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 08/527,679

(22) Filed: Sep. 13, 1995

(51) Int. Cl.[7] ..... B01D 39/20
(52) U.S. Cl. ..... 210/497.01
(58) Field of Search ..... 210/497.01, 497.3, 210/498, 499, 483

(56) References Cited

U.S. PATENT DOCUMENTS

| | | | | |
|---|---|---|---|---|
| 4,394,271 A | * | 7/1983 | Groteke | 210/471 |
| 5,399,265 A | * | 3/1995 | Nehls | 210/499 |

FOREIGN PATENT DOCUMENTS

| | | |
|---|---|---|
| DE | 3631804 | 3/1988 |
| DE | 4337374 | 5/1994 |
| GB | 2046611 | 11/1980 |
| JP | 6937 | 2/1925 |
| JP | 5117269 | 7/1949 |
| JP | 61-209021 | 9/1986 |
| JP | 61180277 | 11/1986 |
| JP | 49614 | 1/1992 |
| JP | 5230525 | 9/1993 |
| JP | 5269321 | 10/1993 |
| JP | 2845707 | 10/1998 |

* cited by examiner

*Primary Examiner*—Ivars Cintins
(74) *Attorney, Agent, or Firm*—Birch, Stewart, Kolasch & Birch LLP

(57) ABSTRACT

A sludge trapping container has a side wall and a bottom each having a plurality of holes defined therein by electron beam machining. Each of the holes has a tapered shape such that the diameter $D_1$ of an end thereof opening at an outer wall surface of the sludge trapping container is smaller than the diameter $D_2$ of an end thereof opening at an inner wall surface of the sludge trapping container. The sludge trapping container is economical as it is suitable for repeated use, and can trap a sludge highly efficiently and can be cleaned highly efficiently because of the gradient of inner surfaces of the holes.

2 Claims, 2 Drawing Sheets

SLUDGE REMOVING DEVICE

BACKGROUND OF THE INVENTION

1. Field of the Invention

The present invention relates to a sludge removing device for removing a sludge mixed in a molten salt-bath solution, and a method of manufacturing such a sludge removing device.

2. Description of the Related Art

Salt-bath softnitriding devices have been used to case-harden an iron-base metallic parts such as automobile parts including crankshafts or the like. Specifically, a salt-bath softnitriding device case-hardens a iron-base metallic part when the iron-base metallic part is immersed in a salt-bath solution in which a salt-bath agent has been heated and molten.

As the case-hardening process continues, the amount of a sludge mixed into the molten salt-bath solution increases tending to degrade the quality of the processed iron-base metallic part. Various methods have heretofore been proposed to remove the sludge from the salt-bath solution. According to one known method, a pot of metal mesh or the like is placed in a salt-bath furnace, the molten salt-bath solution is stirred to float the sludge, and after the stirring has been stopped, the sludge settled on the bottom of the pot is taken, together with the pot, from the salt-bath furnace.

However, the above conventional method is problematic in that the efficiency of the salt-bath softnitriding device is low because the salt-bath softnitriding device is out of operation while the sludge is being removed from the salt-bath furnace.

SUMMARY OF THE INVENTION

It is a general object of the present invention to provide an economic sludge removing device which lends itself to repeated use, and a method of manufacturing such an economic sludge removing device.

A major object of the present invention is to provide a sludge removing device which is capable of efficiently and reliably removing sludge from a molten salt-bath solution, and a method of manufacturing such a sludge removing device.

The above and other objects, features, and advantages of the present invention will become more apparent from the following description when taken in conjunction with the accompanying drawings in which preferred embodiments of the present invention are shown by way of illustrative example.

DETAILED DESCRIPTION OF THE PREFERRED EMBODIMENTS

Figure 1:
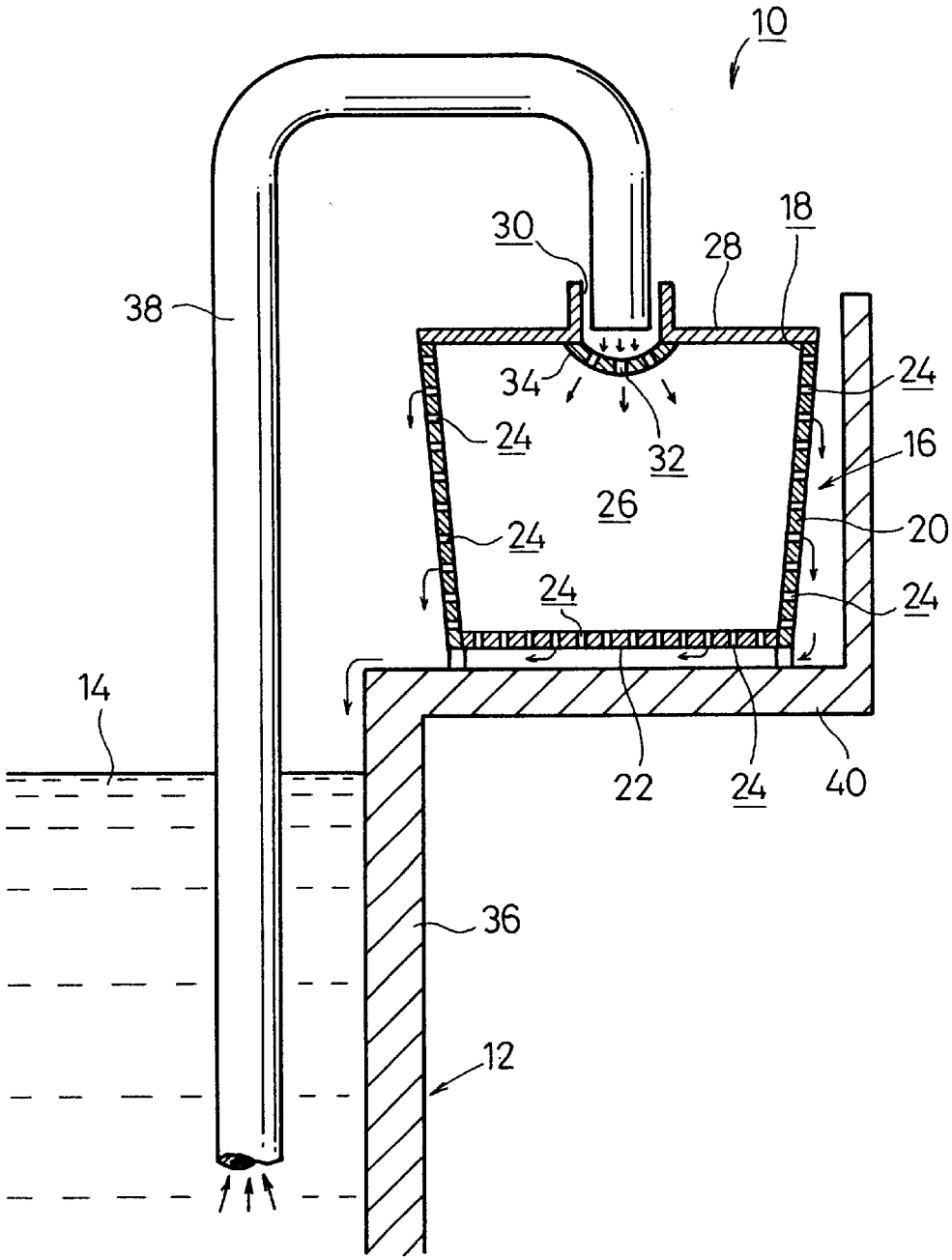
FIG. 1 is a vertical cross-sectional view of a sludge removing device according to an embodiment of the present invention.

As shown in FIG. 1, a sludge removing device 10 according to an embodiment of the present invention comprises a sludge trapping container 16 disposed outside of a molten salt bath 12 and connected to the molten salt bath 12 for circulating a molten salt-bath solution 14 between the sludge trapping container 16 and the molten salt bath 12.

The sludge trapping container 16 is made of a sheet of steel, ceramics, titanium, or alloy steel which is highly resistant to heat and acid and has a thickness in the range of from 0.1 mm to 10.0 mm. The sludge trapping container 16 is in the form of a bottomed cylinder having a covered open end 18. The sludge trapping container 16 has a side wall 20 and a bottom 22 which include a plurality of holes 24 defined therein, each having a diameter ranging from 0.1 mm to 1.0 mm. Adjacent ones of the holes are spaced from each other by a distance which is 1–3 times their diameter. Each of the holes 24 is formed by electron beam machining, and is of a tapered shape such that the diameter $D_1$ of an end thereof opening at an outer wall surface of the sludge trapping container 16 is smaller than the diameter $D_2$ of an end thereof opening at an inner wall surface of the sludge trapping container 16.

The sludge trapping container 16 defines therein an inner space 26 having a greater open area at the covered open end 18 than an open area thereof at the bottom 22. The inner space 26 is of a tapered shape such that it progressively spreads from the bottom 22 toward the covered open end 18. Specifically, the inner space 26 has a diameter of 130 mm at the bottom 22, a diameter of 150 mm at the covered open end 18, and a vertical height of 200 mm.

A cover 28 is mounted in the open end 18 and has a central inlet port 30 for introducing the molten salt-bath solution 14 into the sludge trapping container 16. The cover 28 also has a dispersing cap 34 positioned underneath the inlet port 30 for scattering the molten salt-bath solution 14 in a wide range in the sludge trapping container 16 and reducing the pressure of the molten salt-bath solution 14 that is discharged from the inlet port 30.

The molten salt bath 12 has a bath body 36 made of a corrosion-resistant alloy such as INCONEL (trademark), the bath body 36 being filled with the molten salt-bath solution 14. A pipe 38 has an end immersed in the molten salt-bath solution 14 in the bath body 36 is and connected to a pump (not shown). The other end of the pipe 38 is coupled to the inlet port 30 of the cover 28 which is mounted in the open end 18 of the sludge trapping container 16. The sludge trapping container 16 is removably placed on a frame 40 which is integrally joined to an upper end of the bath body 36.

A process of manufacturing the sludge removing device 10 will be described below.

The side wall 20 and the bottom 22 are fabricated separately from each other, and a number of tapered holes 24 are formed in each of the side wall 20 and the bottom 22 by electron beam machining. The side wall 20 and the bottom 22 are fixed to each other with the larger openings (with the diameter $D_2$) of the holes 24 on the inner wall side, thereby completing the bottomed cylindrical sludge trapping container 16.

Alternatively, after a bottomed cylinder composed of the side wall 20 and the bottom 22 has been fabricated, a plurality of tapered holes 24 may be formed in the side wall 20 and the bottom 22 by electron beam machining.

The sludge trapping container 16 is then placed on the frame 40 extending outside of the molten salt bath 12, and connected to the molten salt bath 12 by the pipe 38 for circulating the molten salt-bath solution 14 between the sludge trapping container 16 and the molten salt bath 12.

The salt-bath agent in the molten salt bath 12 is heated to a given temperature, producing the molten salt-bath solution 14. When iron-base metallic parts are immersed in the molten salt-bath solution 14 for a predetermined period of time, they are case-hardened or nitrided.

As the above nitriding process continues, the amount of a sludge accumulated in the molten salt-bath solution 14 increases. Therefore, a process of removing the accumulated sludge from the molten salt-bath solution 14 is carried out. Specifically, the non-illustrated pump is actuated to draw the molten salt-bath solution 14 in the molten salt bath 12 through the pipe 38. The molten salt-bath solution 14 in the pipe 38 is introduced from above the sludge trapping container 16 through the holes 32 in the dispersing cap 34 into the sludge trapping container 16. After the sludge contained in the molten salt-bath solution 14 has been trapped and removed by the sludge trapping container 16, the molten salt-bath solution 14 flows through the holes 24 in the side wall 20 and the bottom 22, and returns back to the molten salt bath 12.

In this embodiment, the sludge trapping container 16 is composed of sheets of metal with the holes 24 defined therein. Therefore, the area of the sludge trapping container 16 which is held in contact with the molten salt-bath solution 14 is smaller than that of a mesh-like sludge removing device of the same metal material. Consequently, the sludge trapping container 16 is more resistant to erosion by the molten salt-bath solution 14 and more durable than a mesh-like sludge removing device.

The sludge trapping container 16 is made of steel, ceramics, titanium, or alloy steel which is highly resistant to heat and acid. Therefore, the sludge trapping container 16 is highly durable and economic as it is suitable for repeated use.

Figure 2:
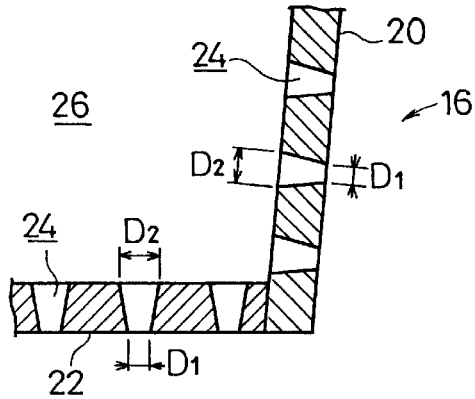
FIG. 2 is an enlarged fragmentary vertical cross-sectional view of a sludge trapping container of the sludge removing device.

In this embodiment, the holes 24 are formed in the side wall 20 and the bottom 22 of the sludge trapping container 16 by electron beam machining. As shown in FIG. 2, each of the holes 24 is of a tapered shape such that the diameter $D_1$ of its end opening at the outer wall surface is smaller than the diameter $D_2$ of its end opening at the inner wall surface.

This tapered hole configuration allows the sludge to be easily and reliably deposited in the holes 24 along the gradient of the inner surfaces of the holes 24, so that the sludge trapping container 16 can trap the sludge highly efficiently. When the sludge trapping container 16 is subsequently placed in and cleaned by an ultrasonic or hot-water cleaning apparatus, the accumulated sludge can smoothly be removed from the holes 24 along the gradient of the inner surfaces of the holes 24. Consequently, the sludge can efficiently be removed from the sludge trapping container 16 when it is cleaned.

Figure 3:
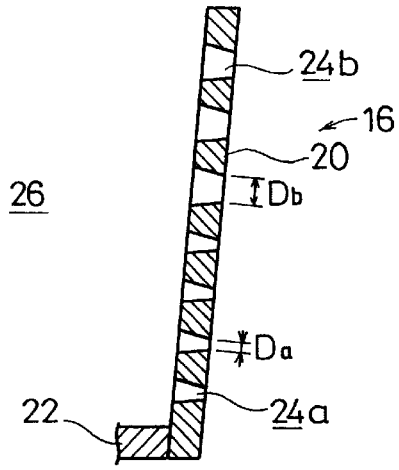
FIG. 3 is an enlarged fragmentary vertical cross-sectional view of a sludge trapping container according to another embodiment of the present invention, the sludge trapping container having two groups of holes having different diameters which are defined in a side wall thereof.

FIG. 3 shows a sludge trapping container 16 according to another embodiment of the present invention. As shown in FIG. 3, the sludge trapping container 16 has a side wall 20 and a bottom 22, and the side wall 20 has a first group of holes 24*a* defined in a region thereof near the bottom 22 and having a diameter $D_a$ of 0.2 mm, for example, and a second group of holes 24*a* defined in a region thereof remote from the bottom 22 and having a diameter D*b* of 0.6 mm, for example.

Since the side wall 20 has two groups of holes 24*a*, 24*b* having different diameters, the single sludge trapping container 16 shown in FIG. 3 is capable of reliably removing sludges of different sizes from the molten salt-bath solution 14.

Figure 4:
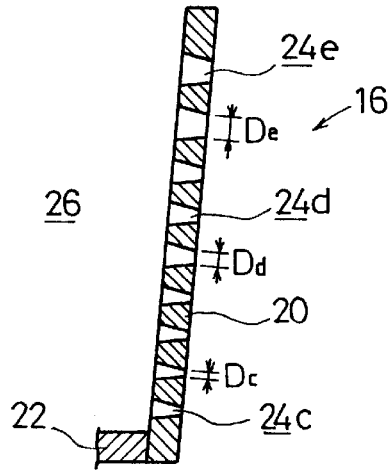
FIG. 4 is an enlarged fragmentary vertical cross-sectional view of a sludge trapping container according to still another embodiment of the present invention, the sludge trapping container having three groups of holes having different diameters which are defined in a side wall thereof.

FIG. 4 shows a sludge trapping container 16 according to still another embodiment of the present invention. As shown in FIG. 4, the sludge trapping container 16 has a side wall 20 and a bottom 22, and the side wall 20 has a first group of holes 24*c*, a second group of holes 24*d*, and a third group of holes 24*e* which are defined successively in respective regions from the bottom 22 toward the upper end, i.e., the end 18 (see FIG. 1). Specifically, the holes 24*c* in the first group, i.e., the lower group, each have a diameter of $D_c$ of 0.2 mm, for example, the holes 24*d* in the second group, i.e., the middle group, each have a diameter $D_d$ of 0.4 mm, for example, and the holes 24*e* in the third group, i.e., the upper group, each have a diameter $D_e$ ranging from 0.6 to 0.8 mm, for example. The sludge trapping container 16 with the three groups of holes 24*c*, 24*d*, 24*e* offers the same advantages as the sludge trapping container 16 with the two groups of holes 24*a*, 24*b*.

While the sludge trapping container 16 is in the form of a bottomed cylinder in the illustrated embodiments, the sludge removing device may comprise a sludge trapping container having a bottomed polygonal tubular shape.

Although certain preferred embodiments of the present invention have been shown and described in detail, it should be understood that various changes and modifications may be made therein without departing from the scope of the appended claims.

What is claimed is:

1. A sludge removing device comprising:

a sludge trapping container for removing a sludge mixed in a molten salt-bath solution;

said sludge trapping container being made of steel, ceramics, titanium, or alloy steel, and having a bottomed cylindrical or bottomed polygonal tubular shape with an open end;

said sludge trapping container including a side wall and a bottom each having a plurality of holes defined therein, wherein each of the holes defined in the side wall and the bottom of said sludge trapping container comprises a tapered hole having a diameter at an end thereof opening at an outer wall surface of said sludge trapping container, said diameter being smaller than a diameter of an end thereof opening at an inner wall surface of said sludge trapping container, wherein the holes defined in the side wall of said sludge trapping container include holes near said bottom and holes remote from said bottom, said holes near said bottom having a diameter smaller than the diameter of said holes remote from said bottom.

2. A sludge removing device according to claim 1, wherein the holes defined in the side wall of said sludge trapping container include at least two groups of holes having diameters progressively greater in a direction remote from said bottom.

* * * * *